US011851904B2

(12) United States Patent
Xian et al.

(10) Patent No.: US 11,851,904 B2
(45) Date of Patent: Dec. 26, 2023

(54) TENT PEG AND PROCESSING METHOD THEREOF

(71) Applicant: Guangzhou Classic & Fresh Crafts Co., Limited, Guangzhou (CN)

(72) Inventors: Minjin Xian, Guangzhou (GD); Yueyun Hu, Guangzhou (CN)

(73) Assignee: GUANGZHOU CLASSIC & FRESH CRAFTS CO., LIMITED, Guangzhou (CN)

( * ) Notice: Subject to any disclaimer, the term of this patent is extended or adjusted under 35 U.S.C. 154(b) by 363 days.

(21) Appl. No.: 17/365,496

(22) Filed: Jul. 1, 2021

(65) Prior Publication Data

US 2022/0003018 A1 Jan. 6, 2022

(30) Foreign Application Priority Data

Jul. 6, 2020 (CN) ..... 202010638833.6

(51) Int. Cl.
*E04H 15/62* (2006.01)

(52) U.S. Cl.
CPC ..... *E04H 15/62* (2013.01)

(58) Field of Classification Search
CPC ..... E04H 15/62
See application file for complete search history.

(56) References Cited

U.S. PATENT DOCUMENTS

| | | | | |
|---|---|---|---|---|
| 5,832,672 | A * | 11/1998 | Griffiths | E04H 15/003 52/166 |
| 7,302,904 | B2 * | 12/2007 | Burns | E04H 15/62 114/294 |
| 10,219,445 | B2 * | 3/2019 | Montagano | A01G 9/124 |
| 10,920,447 | B2 * | 2/2021 | Xian | E04H 15/62 |
| 2004/0099300 | A1 * | 5/2004 | Warren | E04H 15/62 135/118 |
| 2014/0014149 | A1 * | 1/2014 | Jackson | A45B 9/04 135/65 |
| 2019/0380282 | A1 * | 12/2019 | Burshan | E04H 12/2215 |

* cited by examiner

*Primary Examiner* — Noah Chandler Hawk
(74) *Attorney, Agent, or Firm* — Westman, Champlin & Koehler, P.A.

(57) ABSTRACT

The present invention discloses a tent peg, including: a peg cap, a peg body, a first anti-slipping hook, a second anti-slipping hook, and a peg head, wherein mounting holes are provided on both sides of a top end of the peg body opposite to each other; snap-fitting grooves are provided on both sides of a bottom end of the peg body opposite to each other; the first and second anti-slipping hooks are disposed on both sides of the peg body and snap-fitted with each other after successively passing through the two opposite mounting holes; the peg cap is buckled in the top opening of the peg body; and the peg head is mounted at the bottom end of the peg body through the snap-fitting grooves. The present invention also disclose a method for processing a tent peg.

6 Claims, 4 Drawing Sheets

TENT PEG AND PROCESSING METHOD THEREOF

CROSS-REFERENCE TO RELATED APPLICATION

This application claims priority from and the benefit of Chinese Patent Application No. CN202010638833.6, filed Jul. 6, 2020, the content of which is incorporated herein by reference.

TECHNICAL FIELD

The present invention relates to the field of tent accessories, and in particular to a tent peg and a processing method thereof.

BACKGROUND

The existing carbon composite material fiber tent pegs are mostly made of carbon fiber and aluminum materials which are generally formed by sticking metal components made of metal material such as aluminum or aluminum alloy onto both ends of the tube-shaped carbon fiber peg body. Such tent pegs have three defects. Firstly, when the adhesive is aged or overstressed, the metal components will easily fall off, making the product not durable. Secondly, the tube-shaped peg body does not have a hook-shaped point to fix ropes. If the ropes are tied on the tent pegs directly, they may easily slip off. Cord loops are generally used as hook points, and the rope must pass through the cord loops to be fixed, which is inconvenient to use. When users are wearing gloves on low temperature mountains, it will be difficult for them to let the ropes of the tent pass through the cord loops of the peg, and thus it is inconvenient to use on mountains. Thirdly, metal components made of aluminum or aluminum alloy can be easily damaged when impacting the rocks underground or struck by external forces, because the aluminum or aluminum alloy is low in rigidity. If it is simply replaced with a hard metal head made of steel, the weight will be significantly increased.

SUMMARY OF THE INVENTION

An object of the present invention is to overcome the defects of the prior art, and provide a lightweight, firm, durable and convenient tent peg. Another object of the present invention is to provide a method for processing a tent peg.

The objects of the present invention is realized by the following technical solution: a tent peg, including: a peg cap, a peg body, a first anti-slipping hook, a second anti-slipping hook, and a peg head, wherein the peg body is provided with an opening at both ends and a hollow interior; mounting holes are provided on both sides of a top end of the peg body opposite to each other; a gap is provided between the mounting hole and a top opening of the peg body; snap-fitting grooves are provided on both sides of a bottom end of the peg body opposite to each other, and an opening end of the snap-fitting groove is flush with a bottom opening of the peg body; the first and second anti-slipping hooks are disposed on both sides of the peg body and snap-fitted with each other after successively passing through the two opposite mounting holes; the peg cap is buckled in the top opening of the peg body; the peg head is mounted at the bottom end of the peg body through the snap-fitting grooves; both ends of the peg body are poured with a curing adhesive layer such that the adhesive is cured on surfaces of the first and second anti-slipping hooks and the peg head in a cavity of the peg body, increasing the volume thereof in order not to be able to slide out of the cavity of the peg body; the peg cap is connected integrally with the first and second anti-slipping hooks in the cavity of the peg body.

Furthermore, the first anti-slipping hook includes a first hook body, a first snap-fitting block, a first limit block and a first hook claw; the first snap-fitting block is provided at a lower side of an end of the first hook body close to the peg body; the first limit block is provided at an upper side of the end of the first hook body close to the peg body; a first groove corresponding to the second anti-slipping hook is provided at the end of the first hook body close to the peg body; the first groove is located between the first snap-fitting block and first limit block; the first snap-fitting block is snap-fitted with the second anti-slipping hook after passing through the two mounting holes successively; an upper face of the first snap-fitting block is closely adjacent to the second anti-slipping hook; a lower face of the first snap-fitting block is closely adjacent to lower edges of the two mounting holes; the first limit block abuts against the peg body above the mounting hole close thereto; the top end of the peg body is poured with the curing adhesive layer such that the adhesive is cured on surfaces of the first and second anti-slipping hooks in the cavity of the peg body, increasing the volume thereof in order not to be able to slide out of the mounting holes.

Furthermore, the first hook claw is mounted at an end of the first hook body away from the peg body, and is oriented toward the peg body.

Furthermore, the second anti-slipping hook includes a second hook body, a second snap-fitting block, a second limit block and a second hook claw; the second limit block is provided at an upper side of an end of the second hook body close to the peg body; the second snap-fitting block is provided at a lower side of the second limit block; a second groove corresponding to the first anti-slipping hook is provided at the end of the second hook body close to the peg body; the second groove is located at the lower side of the second snap-fitting block; the second snap-fitting block contacts the first groove after passing through the two mounting holes successively, and the second groove contacts the first snap-fitting block such that the first and second anti-slipping hooks are snap-fitted with each other; an upper face of the second snap-fitting block is closely adjacent to upper edges of the two mounting holes; a lower face of the second snap-fitting block is closely adjacent to the first anti-slipping hook; the second limit block abuts against the peg body above the mounting hole close thereto; the bottom end of the peg cap abuts against the second snap-fitting block; the top end of the peg body is poured with the curing adhesive layer such that the adhesive is cured on surfaces of the second snap-fitting block and the first anti-slipping hook in the cavity of the peg body, increasing the volume thereof in order not to be able to slide out of the mounting holes.

Furthermore, the second hook claw is mounted at an end of the second hook body away from the peg body, and is oriented toward the peg body.

Furthermore, the snap-fitting groove includes an inner groove section and an opening section connected to each other; the opening section is flush with the bottom opening of the peg body; and a width of the inner groove section is greater than that of the opening section.

Furthermore, the peg head includes a bump, a pillar and a tip connected successively from top to bottom; the bump mates with the snap-fitting groove in shape and is disposed in the two snap-fitting grooves; the bottom end of the peg body is poured with the curing adhesive layer such that the adhesive is cured on a surface of the bump, increasing the volume thereof in order not to be able to slide out of the snap-fitting grooves. The tip is of a cone shape, and the pillar is of a cylinder shape.

Furthermore, both side surfaces of the bump are arc surfaces.

Furthermore, the peg cap includes a cap lid and a snap-fitting tube in a cylinder shape. The snap-fitting tube is mounted at a bottom end of the cap lid. A diameter of the cap lid is slightly greater than an outer diameter of the peg body. An outer diameter of the snap-fitting tube is slightly smaller than an inner diameter of the cavity of the peg body. A lower edge of the cap lid is closely adjacent to an upper edge of a wall of the peg body. A bottom end of the snap-fitting tube abuts against the second snap-fitting block in the cavity of the peg body.

Furthermore, the peg body is processed from a carbon fiber tube, the first and second anti-slipping hooks are cut from a carbon fiber sheet, and the peg cap and the peg head are made of hard alloy.

A method for processing a tent peg includes the following steps:

obtaining the peg body by cutting a carbon fiber tube;

obtaining the first and second anti-slipping hooks by cutting a carbon fiber sheet;

obtaining the peg cap and the peg head by die casting or lathe cutting;

threading the first snap-fitting block of the first anti-slipping hook into one of the mounting holes of the peg body and out from the opposite mounting hole; threading the second snap-fitting block of the second anti-slipping hook into the other of the mounting holes and out from the opposite mounting hole, such that the first and second anti-slipping hooks are located on both sides of the peg body, the first snap-fitting block is snap-fitted with the second groove, the second snap-fitting block is snap-fitted with the first groove, the upper face of the second snap-fitting block is closely adjacent to the upper edges of the two mounting holes, the lower face of the second snap-fitting block is closely adjacent to the upper face of the first snap-fitting block, and the lower face of the first snap-fitting block is closely adjacent to the lower edges of the two mounting holes;

inserting the peg cap into the top opening of the peg body, such that a bottom surface of the cap lid of the peg cap is closely adjacent to the top edge of the peg body, and the snap-fitting tube of the peg cap abuts against the second snap-fitting block in the cavity of the peg body;

inverting the peg body, pouring the curing adhesive from the bottom opening of the peg body to the direction of the peg cap, waiting still or heating the adhesive to make it cure on the surfaces of the first and second snap-fitting blocks, increasing the volume thereof in order not be able to slide out of the mounting holes, and the peg cap, the inner wall of the peg body, the first and second snap-fitting blocks, and the mounting holes being adhered together;

continuing to pour the curing adhesive into the peg body, making the bump of the peg head slide into the cavity of the peg body from the snap-fitting groove on one side of the bottom end of the peg body and into the snap-fitting groove on the other side; and inverting the peg body such that the curing adhesive in the cavity of the peg body flows back to the bottom of the peg body, and pouring the bump of the peg head and the inner wall at the bottom of the cavity, waiting still or heating the adhesive to make it cure on the surface of the bump, increasing the volume thereof in order not to be able to slide out of the snap-fitting groove, the peg head and the snap-fitting grooves being adhered together.

The principle of the present invention is that the peg body and the first anti-slipping hook and the second anti-slipping hook of the tent peg herein are made of carbon fiber material and the peg cap and the peg head are made of hard metal material. The weight of the tent peg can be greatly reduced, and the rigidity of the bottom and top of the tent peg can be significantly increased, enhancing the practicability, anti-striking and penetration ability of the tent peg. Mounting holes are provided at the top end of the peg body opposite to each other, and the first and second anti-slipping hooks and the peg cap can be fixed by snap-fitting with each other and pouring curing adhesive. The peg cap is closely adjacent to the upper edge of the peg body and the second anti-slipping hook, and the first and second anti-slipping hooks and the peg body are closely adjacent to each other. In this way, the pressure applied by the peg cap to the top edge of the peg boy can be shared, which can make the anti-slipping hooks stable and firm but also can enhance the resistance ability of the peg cap and the peg cap against vertical external force. By disposing snap-fitting grooves which are wide at the top and narrow at the bottom on both sides of the bottom end of the peg body, the shape of the bump of the peg head mates with the snap-fitting grooves, such that the peg head is fixed in the snap-fitting grooves firmly in the vertical direction, and by pouring the curing adhesive, the peg head can be connected integrally with the peg body.

The curing adhesive is preferred to be epoxy resin, because the carbon fiber per se contains epoxy resin, which can bond together firmly after curing epoxy resin and will not fall off easily. The curing adhesive not just acts as an adhesive, but also increases the volume of the first and second snap-fitting blocks and the bump after being poured and cured on the surfaces thereof, forming an anti-slipping structure and being snap-fitted firmly in the cavity of the peg body. Furthermore, the cured adhesive fills the gaps at the snap-fitting places, and has the effect of beautifying products.

Compared with the prior art, the present invention has advantages as below:

The tent peg in the present invention provides a new idea of providing anti-slipping hooks in the tube-shaped carbon fiber peg body. Mounting holes are provided on both sides of the top end of the peg body. The first and second anti-slipping hooks are snap-fitted with each other after being inserted into the peg body along the mounting holes on both sides of the peg body, and form a locking structure after the curing adhesive is poured and cured to increase the volume thereof, and is also integrally connected with the peg cap. Such a provision can share the pressure applied by the peg cap to the top edge of the peg body, which can not only improve the firmness between the first and second anti-slipping hooks and the peg body, but can also enhance the resistance ability of the peg cap against vertical external forces.

The unique connection structure of the peg head and the peg body can make the peg head of the tent peg herein sturdy and durable, not easy to fall off, significantly prolonging the service life of the peg. In common tubular carbon fiber and aluminum alloy tent pegs, a cylindrical metal head is simply adhered in the cavity of the peg body. The adhesive will be easily cracked or aged after long time of stressing, and the metal head is easy to fall off. Alternatively, when such a peg is inserted into hard ground, the metal head is stuck under the ground because of the pressure of the mud, and the adhesive layer may be easily damaged when the peg is forced to be pulled out of the ground, causing the metal head to fall off. In the peg according to the present invention, the bump can only slide into the peg body from the side, and the peg head cannot be pulled out of the snap-fitting grooves by forces in the vertical direction. Furthermore, the curing adhesive is integrally connected with the bump of the peg head in the peg body after being cured, increasing the volume of the bump, so that the bump is snap-fitted in the snap-fitting grooves at the bottom end of the peg body firmly and will not fall off easily.

BRIEF DESCRIPTION OF THE DRAWINGS

The accompanying drawings constituting a part of the present invention are used to provide a further understanding of the present invention. Exemplary embodiments of the present invention and descriptions thereof are used to explain the present invention, and do not constitute an improper limitation of the present invention, in which.

1, peg cap; 2, peg body; 3, first anti-slipping hook; 4, second anti-slipping hook; 5, peg head; 6, mounting hole; 7, snap-fitting groove; 8, first hook body; 9, first snap-fitting block; 10, first limit block; 11, first groove; 12, first hook claw; 13, second hook body; 14, second snap-fitting block; 15, second limit block; 16, second groove; 17, second hook claw; 18, inner groove section; 19, opening section; 20, bump; 21, pillar; 22, tip; 23, cap lid; 24, snap-fitting tube; 25, curing adhesive.

DETAILED DESCRIPTION

The present invention is further described below in combination with the accompanying drawings and preferred embodiments.

Figure 1:
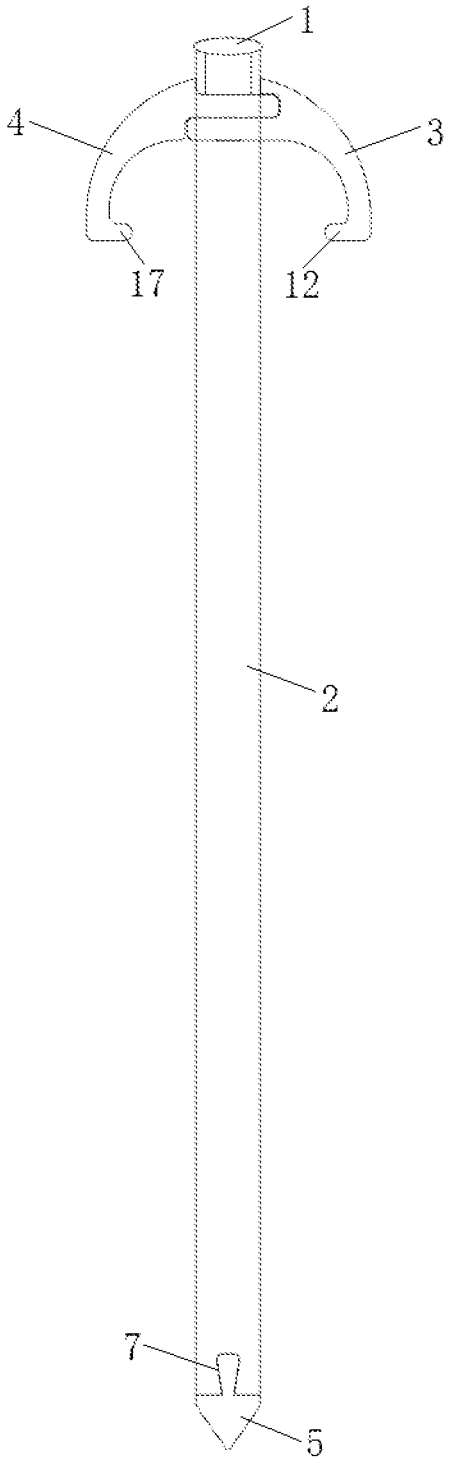
FIG. 1 is a structural diagram of a tent peg according to the present invention.

As shown in FIG. 1, a tent peg includes a peg cap 1, a peg body 2, a first anti-slipping hook 3, a second anti-slipping hook 4, and a peg head 5. The peg body 2 is provided with an opening at both ends and a hollow interior. Mounting holes 6 are provided on both sides of a top end of the peg body 2 opposite to each other. A gap is provided between the mounting hole 6 and a top opening of the peg body 2. Snap-fitting grooves 7 are provided on both sides of a bottom end of the peg body 2 opposite to each other. An opening end of the snap-fitting groove 7 is flush with a bottom opening of the peg body 2. The first anti-slipping hook 3 and the second anti-slipping hook 4 are disposed on both sides of the peg body 2 and snap-fitted with each other after successively passing through the two opposite mounting hole 6. The peg cap 1 is buckled in the top opening of the peg body 2. The peg head 5 is mounted at the bottom end of the peg body 2 through the snap-fitting grooves 7. Both ends of the peg body 2 are poured with a curing adhesive layer 25 which is cured on surfaces of the first anti-slipping hook 3, the second anti-slipping hook 4 and the peg head 5 in a cavity of the peg body 2, increasing the volume thereof to be larger than the mounting hole 6 and the opening of the snap-fitting groove 7 in order not to be able to slide out of the cavity of the peg body 2. By providing the curing adhesive layer 25, the peg cap 1 is connected integrally with the first anti-slipping hook 3 and the second anti-slipping hook 4 in the cavity of the peg body 2. The curing adhesive refers to an adhesive that can undergo curing reaction at room temperature or after heating, such as phenolic resin, epoxy resin, amino resin, unsaturated polyester resin, and the like.

The peg body 2 is of a round tube shape with openings at both ends. The first anti-slipping hook 3, the second anti-slipping hook 4, the peg cap 1 and the peg head 5 are mounted on the peg body 2 through the mounting holes 6 and the snap-fitting grooves 7. The curing adhesive is poured at both ends of the cavity of the peg body 2, and undergo curing reaction at room temperature or after heating to be cured on surfaces of the first anti-slipping hook 3, the second anti-slipping hook 4, and the peg head 5 in the cavity of the peg body 2, increasing the volume thereof to form an anti-slipping structure which is connected integrally with the mounting holes 6 at the top end of the peg body 2 and the snap-fitting grooves 7 at the bottom end of the peg body 2 firmly, enhancing the firmness of the whole tent peg.

Figure 2:
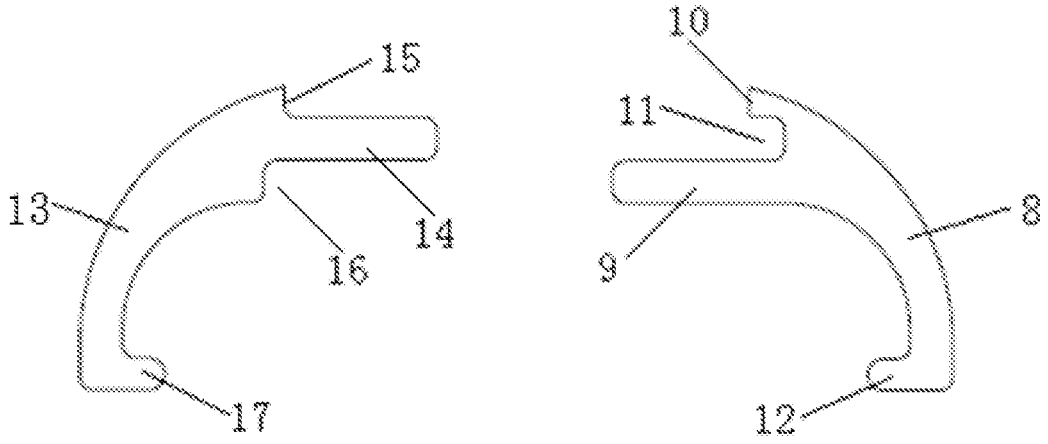
FIG. 2 is a structural diagram of first and second anti-slipping hooks according to the present invention.

As shown in FIG. 2, the first anti-slipping hook 3 includes a first hook body 8, a first snap-fitting block 9, a first limit block 10, and a first hook claw 12. The first snap-fitting block 9 is disposed at a lower side of an end of the first hook body 8 close to the peg body 2. The first limit block 10 is disposed at an upper side of the end of the first hook body 8 close to the peg body 2. A first groove 11 corresponding to the second anti-slipping hook 4 is provided at the end of the first hook body 9 close to the peg body 2. The first groove 11 is located between the first snap-fitting block 9 and the first limit block 10. The first snap-fitting block 9 is snap-fitted with the second anti-slipping hook 4 after passing through the two mounting holes 6 successively. An upper face of the first snap-fitting block 9 is closely adjacent to the second anti-slipping hook 4. A lower face of the first snap-fitting block 9 is closely adjacent to lower edges of the two mounting holes 6. The first limit block 10 abuts against the peg body 2 at the mounting hole 6 close thereto. The top end of the peg body 2 is poured with the curing adhesive layer 25 which is cured on surfaces of the first snap-fitting block 9 and the second anti-slipping hook 4 in the cavity of the peg body 2, increasing the volume thereof to be greater than the opening of the mounting hole 6 in order not to be able to slide out of the mounting holes 6. The first hook claw 12 is mounted at an end of the first hook body 8 away from the peg body 2, and is oriented toward the peg body 2.

The second anti-slipping hook 4 includes a second hook body 13, a second snap-fitting block 14, a second limit block 15 and a second hook claw 17. The second limit block 15 is disposed at an upper side of an end of the second hook body 13 close to the peg body 2. The second snap-fitting block 14 is disposed at a lower side of the second limit block 15. A second groove 16 corresponding to the second snap-fitting block 14 is provided at the end of the second hook body 13 close to the peg body 2. The second groove 16 is located at a lower side of the second snap-fitting block 14. The second snap-fitting block 14 contacts the first groove 11 of the first anti-slipping hook 3 after successively passing through the two mounting holes 6. The second groove 16 contacts the first snap-fitting block 9, such that the first anti-slipping hook 3 and the second anti-slipping hook 4 are snap-fitted with each other. An upper face of the second snap-fitting block 14 is closely adjacent to upper edges of the two mounting holes 6. A lower face of the second snap-fitting block 14 is closely adjacent to the first anti-slipping hook 3. The second limit block 15 abuts against the peg body 2 at the mounting hole 6 close thereto. The bottom end of the peg cap 1 abuts against the second snap-fitting block 14. The top end of the peg body 2 is poured with the curing adhesive layer 25 which is cured on surfaces of the second snap-fitting block 14 and the first snap-fitting block 9 in the cavity of the peg body, increasing the volume thereof to be greater than the opening of the mounting hole 6 in order not to be able to slide out of the mounting holes 6. The second hook claw 17 is mounted at an end of the second hook body 13 away from the peg body 2, and is oriented toward the peg body 2.

In this embodiment, the mounting hole is a square hole. In a specific implementation, four corners of the square hole can be rounded. The first hook body 8 and the second hook body 13 are in arc shape facing down, and used for fixing ropes. The length of the first snap-fitting block 9 and the second snap-fitting block 14 is greater than the outer diameter of the peg body 2, such that the two snap-fitting blocks can pass into a corresponding mounting holes and out of the other mounting hole completely to be snap-fitted with a corresponding groove. The width of the mounting hole 6 matches the width of the first snap-fitting block 9 and the second snap-fitting block 14. The height of the mounting hole matches the total height of the first snap-fitting block 9 and the second snap-fitting block 14. By means of such a provision, the first snap-fitting block 9 and the second snap-fitting block 14 will not rotate or slide after being inserted into the mounting holes 6. The volume of the first snap-fitting block 9 and the second snap-fitting block 14 in the cavity of the peg body 2 will increase after the curing adhesive (preferred to be epoxy resin) is poured and cured, while the size of the mounting hole 6 of the peg body 2 remain unchanged. Thus, the first anti-slipping hook 3 and the second anti-slipping hook 4 can be fixed on both sides of the peg body 2 firmly, and an external force applied to the two anti-slipping hooks can be shared with the edges of the mounting holes at both sides of the peg body, prolonging the service life of the tent peg while enhancing the firmness. The provision of the first limit block 10 and the second limit block 15 can prevent the first snap-fitting block 9 and the second snap-fitting block 14 from ceaselessly passing into the mounting holes, and make the protrusion distance of the two snap-fitting blocks mate with the length of the two grooves. The provision of the first hook claw 12 and the second hook claw 17 can prevent the ropes and the like from sliding out of the anti-slipping hooks when in use.

Figure 3:
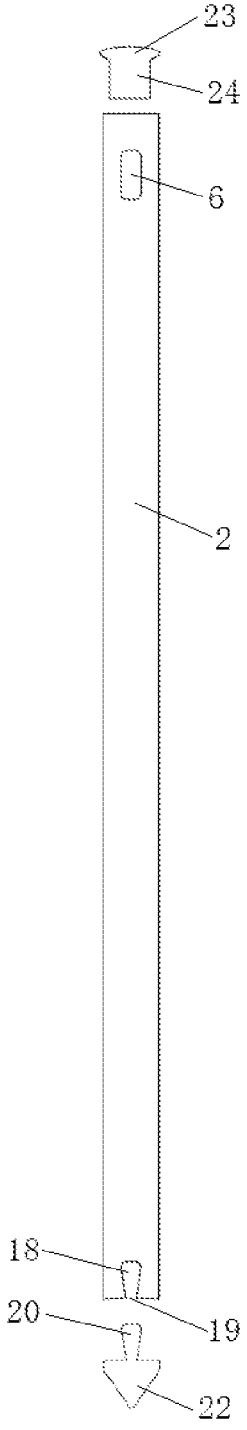
FIG. 3 is a disassembly diagram of a peg cap, a peg body and a peg head according to the present invention.
Figure 4:
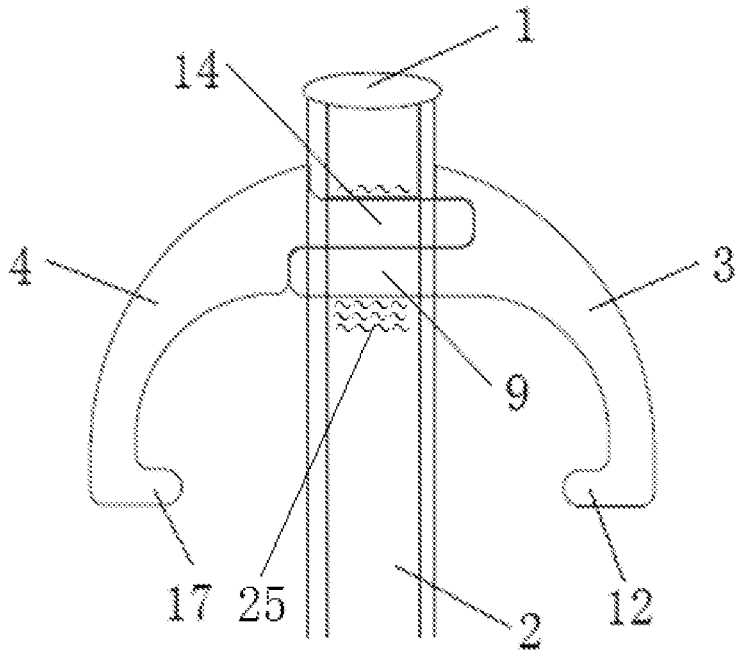
FIG. 4 is a sectional view of the first and second anti-slipping hooks being mounted to the peg body according to the present invention.

As shown in FIG. 3 and FIG. 4, the snap-fitting groove 7 includes an inner groove section 18 and an opening groove 19 connected to each other. The opening section 19 is flush with the bottom opening of the peg body 2. The width of the inner groove section 18 is greater than that of the opening section 19. In this embodiment, the snap-fitting groove 7 is in an inverted trapezoid shape. In an actual implementation, the snap-fitting groove 7 can be of other shapes such as an inverted convex shape in which the inner groove section 18 is smaller than the inner groove section 18 in order to prevent the peg head 5 escaping from the snap-fitting grooves 7 in a vertical direction.

Figure 5:
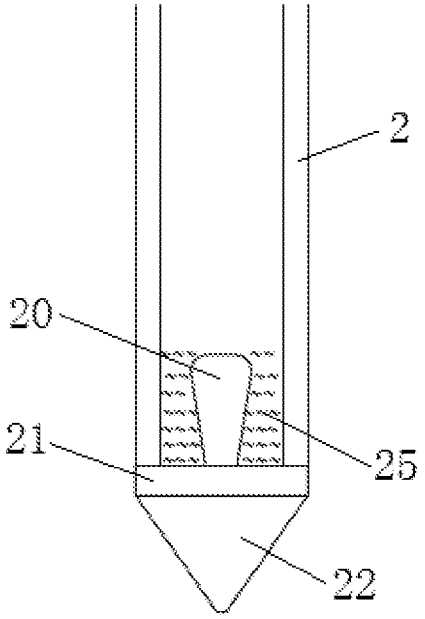
FIG. 5 is a sectional view of the peg head being mounted on the peg body according to the present invention.

As shown in FIG. 5, the peg head 5 includes a bump 20, a pillar 21 and a tip 22 connected successively from top to bottom. The bump 20 mates with the snap-fitting groove 7 in shape, i.e., a structure which is wide at top and narrow at bottom. The bump 20 of the peg head 5 slides from the snap-fitting groove 7 at one side into the cavity of the peg body 2, and into the snap-fitting groove 7 at the other side, while the bottom of the peg body 2 is closely adjacent to the top end of the pillar 21 of the peg head 5. Since the snap-fitting groove 7 at the bottom end of the peg body 2 is in a shape which is wide at top and narrow at bottom and the bump 20 of the peg head 5 is also in a shape which is wide at top and narrow at bottom, the peg head 5 cannot slide out of the cavity of the peg body 2 in an upright state. The inner-tube space where the interior of the peg body 2 intersects with the bump 20 is poured with the curing adhesive layer 25 (preferred to be epoxy resin) which is cured on a surface of the bump 20, increasing the volume of the bump 20 such that the width of the bump 20 in the cavity is greater than the width of the snap-fitting grooves 7 at both sides of the bottom end of the peg body and the bump 20 cannot slide out of the snap-fitting grooves 7 and is integrally connected with the snap-fitting grooves 7. This unique design can fix the peg head 5 firmly below the peg body 2 to stand up relative strong forces from various directions, effectively enhancing the firmness and prolonging the service life of the peg.

Both side surfaces of the bump 20 are arc surfaces, such that the bump 20 of the peg head 5 can form a complete cylindrical surface with the peg body 2 after being snapped into the snap-fitting groove 7. The tip 22 is of a cone shape. The pillar 21 is of a cylinder shape.

As shown in FIG. 4, the peg cap 1 includes a cap lid 23 and a snap-fitting tube 24 in a cylinder shape. The snap-fitting tube 24 is mounted at a bottom end of the cap lid 23. The diameter of the cap lid 23 is slightly greater than the outer diameter of the peg body 2. The outer diameter of the snap-fitting tube 24 is slightly smaller than the inner diameter of the cavity of the peg body 2. The lower edge of the cap lid 23 is closely adjacent to the upper edge of the top opening of the peg body 2. The bottom end of the snap-fitting tube 24 abuts against the second snap-fitting block 4 in the cavity of the peg body. An upper face of the cap lid 23 is an arch surface or a flat surface for convenience of striking. Through the provision of the curing adhesive layer 25, the snap-fitting tube 24 is connected integrally with the second snap-fitting block 14, the first snap-fitting block 9, and the peg body 2. When the peg cap 1 is struck by an external force, the pressure on the cap lid 23 perpendicular to the peg body 2 can be spread to the side edges at the top end of the peg body 2 and also spread to the snap-fitting blocks of the two anti-slipping hooks. Since the two snap-fitting blocks are closely adjacent to the edges of the mounting holes 6, the external force applied to the snap-fitting blocks can be passed back to the peg body 2 through the side edges of the mounting holes 6. With such a provision, the force applied to the peg cap 1 is spread to the top edge of the peg body 2 and the snap-fitting blocks of the two anti-slipping hooks, which provides two extra force bearing points compared to conventional peg caps 1 to share the pressure on the peg cap 1, improving the bearing structure of the entire peg, and also allowing the peg body 2 to be designed thinner and lighter.

The peg body 2 is processed from a carbon fiber tube. The first anti-slipping hook 3 and the second anti-slipping hook 4 are cut from a carbon fiber sheet. The peg cap 1 can be made of stainless steel or other hard alloy. The peg head 5 can be made of zinc alloy or other hard alloy. Such a provision makes the tent peg light (which only weights 6 g, 40% lighter than common lightweight tent pegs made of aluminum or titanium and other materials, and 80% lighter than common tent pegs made of iron), and also very firm and durable. Pure carbon fiber pegs or ordinary aluminum metal head pegs cannot be knocked directly on the top, nor can they be used in places with more frozen soil or sand. The peg herein can be knocked on the top with external force, and the peg head 5 has a higher hardness and can easily penetrate into frozen ground and sandy ground.

A method for processing a tent peg includes the following steps:

obtaining the peg body 2 by cutting a carbon fiber tube;

obtaining the first anti-slipping hook 3 and the second anti-slipping hook 4 by cutting a carbon fiber sheet;

obtaining the peg cap 1 and the peg head 5 by die casting or lathe cutting;

threading the first snap-fitting block 9 of the first anti-slipping hook 3 into one of the mounting hole 6 and out from the opposite mounting hole 6; threading the second snap-fitting block 14 of the second anti-slipping hook 4 into the other of the mounting holes 6 and out from the opposite mounting hole 6, such that the first anti-slipping hook 3 and the second anti-slipping hook 4 are located on both sides of the peg body 2, the first snap-fitting block 9 is snap-fitted with the second groove 11 and the second snap-fitting block 14 is snap-fitted with the first groove, the upper face of the second snap-fitting block 14 are closely adjacent to the upper edges of the mounting holes 6, the lower face of the second snap-fitting block 14 are closely adjacent to the upper face of the first snap-fitting block 9, and the lower face of the first snap-fitting block 9 is closely adjacent to the lower edges of the mounting holes 6.

inserting the peg cap 1 into the top opening of the peg body 2, such that the bottom surface of the cap lid 23 is closely adjacent to the top edge of the peg body 2, and the snap-fitting tube 24 of the peg cap 1 abuts against the second snap-fitting block 14 in the cavity of the peg body 2;

inverting the peg body 2, pouring the curing adhesive from the bottom opening of the peg body 2 to the direction of the top opening, waiting still or heating the adhesive to make it cure on the surfaces of the first snap-fitting block 9 and the second snap-fitting block 14, increasing the volume of the first snap-fitting block 9 and the second snap-fitting block 14 in order not be able to slide out of the mounting holes, and the peg cap 1, the inner wall of the peg body 2, the first snap-fitting block 9, the second snap-fitting block 14, and the mounting hole 6 are adhered together;

pouring the curing adhesive into the peg body 2, making the bump 20 of the peg head 5 slide from the snap-fitting groove 7 on one side of the peg body 2 into the snap-fitting groove 7 on the other side; and inverting the peg body 2, such that the adhesive flows back to the bottom of the peg body 2, and pouring the bump 20 of the peg head 5 and the inner wall of the bottom of the cavity of the peg body 2, and wait stilling or heating the adhesive to make it cure on the surface of the bump 20 of the peg head 5, increasing the volume of the bump 20 in order not to be able to slide out of the snap-fitting groove 7, and the peg head 5 and the bottom end of the peg body 2 are adhered together.

The processing of the tent peg disclosed herein is completed.

In the method for processing a tent peg, the order of disposing the peg cap, the first anti-slipping hook, the second anti-slipping hook and the peg head and the order of pouring the curing adhesive can be switched.

The curing adhesive in the processing method is preferred to be epoxy resin because of the characteristics of the carbon fiber material. The curing adhesive herein not just functions to adhere, but also increases the volume of the first snap-fitting block 9, the second snap-fitting block 14 and the bump 20 of the peg head 5 through its curing reaction, so as to be snap-fitted firmly to the peg body 2, enhancing the firmness of the whole tent peg.

Described above are preferred embodiments of the present invention, and are not intended to limit the present invention. Any changes or equivalent substitutions without departing from the technical solution of the present invention are all included in the protection scope of the present invention.

What is claimed is:

1. A tent peg, comprising: a peg cap, a peg body, a first anti-slipping hook, a second anti-slipping hook, and a peg head, wherein the peg body is provided with an opening at both ends and a hollow interior; mounting holes are provided on both sides of a top end of the peg body opposite to each other; a gap is provided between the mounting hole and a top opening of the peg body; snap-fitting grooves are provided on both sides of a bottom end of the peg body opposite to each other, and an opening end of the snap-fitting groove is flush with a bottom opening of the peg body; the first and second anti-slipping hooks are disposed on both sides of the peg body and snap-fitted with each other after successively passing through the two opposite mounting holes; the peg cap is buckled in the top opening of the peg body; the peg head is mounted at the bottom end of the peg body through the snap-fitting grooves; both ends of the peg body are poured with a curing adhesive layer such that the adhesive is cured on surfaces of the first and second anti-slipping hooks and the peg head in a cavity of the peg body, increasing the volume thereof in order not to be able to slide out of the cavity of the peg body; the peg cap is connected integrally with the first and second anti-slipping hooks in the cavity of the peg body; the peg cap comprises a cap lid and a snap-fitting tube mounted at a bottom end of the cap lid, a diameter of the cap lid is slightly greater than an outer diameter of the peg body, and an outer diameter of the snap-fitting tube is slightly smaller than an inner diameter of the cavity of the peg body; a lower edge of the cap lid is closely adjacent to an upper edge of a wall of the peg body, and a bottom end of the snap-fitting tube abuts against the second anti-slipping hook in the cavity of the peg body; and the peg body is processed from a carbon fiber tube, the first and second anti-slipping hooks are cut from a carbon fiber sheet, and the peg cap and the peg head are made of hard alloy.

2. The tent peg according to claim 1, wherein the first anti-slipping hook comprises a first hook body, a first snap-fitting block, a first limit block and a first hook claw; the first snap-fitting block is provided at a lower side of an end of the first hook body close to the peg body; the first limit block is provided at an upper side of the end of the first hook body close to the peg body; a first groove corresponding to the second anti-slipping hook is provided at the end of the first hook body close to the peg body; the first groove is located between the first snap-fitting block and first limit block; the first snap-fitting block is snap-fitted with the second anti-slipping hook after passing through the two mounting holes successively; an upper face of the first snap-fitting block is closely adjacent to the second anti-slipping hook; a lower face of the first snap-fitting block is closely adjacent to lower edges of the two mounting holes; the first limit block abuts against the peg body above the mounting hole close thereto; the top end of the peg body is poured with the curing adhesive layer such that the adhesive is cured on surfaces of the first and second anti-slipping hooks in the cavity of the peg body, increasing the volume thereof in order not to be able to slide out of the mounting holes; and the first hook claw is mounted at an end of the first hook body away from the peg body, and is oriented toward the peg body.

3. The tent peg according to claim 1, wherein the second anti-slipping hook comprises a second hook body, a second snap-fitting block, a second limit block and a second hook claw; the second limit block is provided at an upper side of an end of the second hook body close to the peg body; the second snap-fitting block is provided at a lower side of the second limit block; a second groove corresponding to the first anti-slipping hook is provided at the end of the second hook body close to the peg body; the second groove is located at the lower side of the second snap-fitting block; the second snap-fitting block contacts the first groove after passing through the two mounting holes successively, and the second groove contacts the first snap-fitting block such that the first and second anti-slipping hooks are snap-fitted with each other; an upper face of the second snap-fitting block is closely adjacent to upper edges of the two mounting holes; a lower face of the second snap-fitting block is closely adjacent to the first anti-slipping hook; the second limit block abuts against the peg body above the mounting hole close thereto; the bottom end of the peg cap abuts against the second snap-fitting block; the top end of the peg body is poured with the curing adhesive layer such that the adhesive is cured on surfaces of the second snap-fitting block and the first anti-slipping hook in the cavity of the peg body, increasing the volume thereof in order not to be able to slide out of the mounting holes; and the second hook claw is mounted at an end of the second hook body away from the peg body, and is oriented toward the peg body.

4. The tent peg according to claim 1, wherein the snap-fitting groove comprises an inner groove section and an opening section connected to each other; the opening section is flush with the bottom opening of the peg body; and a width of the inner groove section is greater than that of the opening section.

5. The tent peg according to claim 1, wherein the peg head comprises a bump, a pillar and a tip connected successively from top to bottom; the bump mates with the snap-fitting groove in shape and is disposed in the two snap-fitting grooves; the bottom end of the peg body is poured with the curing adhesive layer such that the adhesive is cured on a surface of the bump, increasing the volume thereof in order not to be able to slide out of the snap-fitting grooves.

6. A method for processing a tent peg according to claim 1, comprising the steps of:

obtaining the peg body by cutting a carbon fiber tube;

obtaining the first and second anti-slipping hooks by cutting a carbon fiber sheet;

obtaining the peg cap and the peg head by die casting or lathe cutting;

threading the first snap-fitting block of the first anti-slipping hook into one of the mounting holes of the peg body and out from the opposite mounting hole; threading the second snap-fitting block of the second anti-slipping hook into the other of the mounting holes and out from the opposite mounting hole, such that the first and second anti-slipping hooks are located on both sides of the peg body, the first snap-fitting block is snap-fitted with the second groove, the second snap-fitting block is snap-fitted with the first groove, the upper face of the second snap-fitting block is closely adjacent to the upper edges of the two mounting holes, the lower face of the second snap-fitting block is closely adjacent to the upper face of the first snap-fitting block, and the lower face of the first snap-fitting block is closely adjacent to the lower edges of the two mounting holes;

inserting the peg cap into the top opening of the peg body, such that a bottom surface of the cap lid of the peg cap is closely adjacent to the top edge of the peg body, and the snap-fitting tube of the peg cap abuts against the second snap-fitting block in the cavity of the peg body;

inverting the peg body, pouring the curing adhesive from the bottom opening of the peg body to the direction of the peg cap, waiting still or heating the adhesive to make it cure on the surfaces of the first and second snap-fitting blocks, increasing the volume thereof in order not be able to slide out of the mounting holes, and the peg cap, the inner wall of the peg body, the first and second snap-fitting blocks, and the mounting holes being adhered together;

continuing to pour the curing adhesive into the peg body, making the bump of the peg head slide into the cavity of the peg body from the snap-fitting groove on one side of the bottom end of the peg body and into the snap-fitting groove on the other side; and inverting the peg body such that the curing adhesive in the cavity of the peg body flows back to the bottom of the peg body, and pouring the bump of the peg head and the inner wall at the bottom of the cavity of the peg body, waiting still or heating the adhesive to make it cure on the surface of the bump, increasing the volume thereof in order not to be able to slide out of the snap-fitting grooves, the peg head and the snap-fitting grooves being adhered together.

* * * * *